US010005124B2

(12) United States Patent
Lee et al.

(10) Patent No.: US 10,005,124 B2
(45) Date of Patent: Jun. 26, 2018

(54) MULTIPLE PRESSURE CASTING MOLD AND MOLDED PRODUCT MANUFACTURING METHOD USING SAME

(71) Applicant: KOREA INSTITUTE OF INDUSTRIAL TECHNOLOGY, Cheonan-si, Chungcheongnam-do (KR)

(72) Inventors: Young Cheol Lee, Incheon (KR); Jeong Tae Kim, Incheon (KR)

(73) Assignee: Korea Institute of Industrial Technology, Cheonan-si, Chungcheongnam-do (KR)

( * ) Notice: Subject to any disclaimer, the term of this patent is extended or adjusted under 35 U.S.C. 154(b) by 50 days.

(21) Appl. No.: 15/116,981

(22) PCT Filed: Feb. 6, 2015

(86) PCT No.: PCT/KR2015/001234

§ 371 (c)(1),
(2) Date: Aug. 5, 2016

(87) PCT Pub. No.: WO2015/119449

PCT Pub. Date: Aug. 13, 2015

(65) Prior Publication Data

US 2017/0173677 A1 Jun. 22, 2017

(30) Foreign Application Priority Data

Feb. 7, 2014 (KR) ..... 10-2014-0014336

(51) Int. Cl.
*B22D 13/06* (2006.01)
*B22D 13/10* (2006.01)

(52) U.S. Cl.
CPC ..... *B22D 13/06* (2013.01); *B22D 13/107* (2013.01)

(58) Field of Classification Search
CPC ..... B22D 13/06; B22D 13/10; B22D 13/107
(Continued)

(56) References Cited

U.S. PATENT DOCUMENTS 2,972,172 A * 2/1961 Federman ..... B22D 17/10 164/113
3,752,214 A * 8/1973 Pertot ..... B22D 13/026 164/138
(Continued)

FOREIGN PATENT DOCUMENTS

JP 63-168265 A 7/1988
JP 07-241658 A 9/1995
(Continued)

OTHER PUBLICATIONS

Korea Office Action dated Jun. 20, 2016.

*Primary Examiner* — Kevin P Kerns
(74) *Attorney, Agent, or Firm* — Rabin & Berdo, P.C.

(57) ABSTRACT

A multiple pressure casting mold includes a mold part having upper and lower molds, each having molten metal injection ports and the molded product accommodating parts for accommodating the molten metal for the molded product, a rotating unit for rotating the mold part so as to allow the molten metal injected through the molten metal injection ports to flow into the molded product accommodating parts, and a molten metal injection control unit having upper and lower pressing parts for pressing the molten metal injected through the molten metal injection ports so as to allow the molten metal to flow into the molded product accommodating parts with the rotating unit.

17 Claims, 7 Drawing Sheets

(58) Field of Classification Search
USPC ..... 164/146, 147.1, 286, 289, 290, 296, 114
See application file for complete search history.

(56) References Cited

U.S. PATENT DOCUMENTS

| | | | | | |
|---|---|---|---|---|---|
| 4,492,264 | A | | 1/1985 | Gaddi | |
| 5,143,141 | A | * | 9/1992 | Frulla | B22D 18/02 164/120 |
| 5,191,923 | A | * | 3/1993 | Goss | B22D 13/101 164/290 |
| 5,223,278 | A | * | 6/1993 | Nicetto | B22D 13/04 164/286 |
| 5,579,825 | A | * | 12/1996 | Shibata et al. | B22D 17/007 164/113 |

FOREIGN PATENT DOCUMENTS

| | | | |
|---|---|---|---|
| JP | 2861403 | B2 | 2/1999 |
| JP | 2001-047207 | A | 2/2001 |
| KR | 10-0449426 | B1 | 9/2004 |
| KR | 10-2005-0029894 | A | 3/2005 |
| KR | 10-2011-0126488 | A | 11/2011 |

* cited by examiner

MULTIPLE PRESSURE CASTING MOLD AND MOLDED PRODUCT MANUFACTURING METHOD USING SAME

TECHNICAL FIELD

The present invention relates to a mold and, more particularly, to a multiple pressure casting mold and a molded product manufacturing method using the same.

BACKGROUND ART

Casting is a manufacturing process in which a molten metal is poured into a mold and cooled, thereby forming a molded product of the desired shape after removing the mold. A variety of casting machines have been developed for performing an efficient casting process.

Molded products such as motor rotors, master cylinders, or the like can be manufactured by using the casting machines.

However, such molded products manufactured by using the casting mold have many defects, thus improved devices and methods capable of manufacturing molded products are still required.

As a related art technique, there is disclosed Korean Patent registration No. 10-0449426 (registered on Sep. 9, 2004).

DISCLOSURE

Technical Problems

An object of the present invention is to provide a multiple pressure casting mold that is capable of casting a molded product by allowing a molten metal to flow into a molded product accommodating part by using centrifugal force and pressure during casting such that the molten metal can be quickly and uniformly injected into the molded product accommodating part, thereby enabling the casting of the molded product having a dense structure, and a molded product manufacturing method using the same.

Further, another object of the present invention is to provide a multiple pressure casting mold allowing a molten metal to be casted in a convenient manner while being exposed in an electromagnetic field for a sufficient time period, and a molded product manufacturing method using the same.

Technical problems to be solved by the present invention however are not limited to the above-mentioned problems.

Technical Solution

In order to accomplish the above objects, according to embodiments of the present invention, there is provided a multiple pressure casting mold including: a mold part having upper and lower molds, each having molten metal injection ports and molded product accommodating parts for accommodating the molten metal for the molded product; a rotary unit for rotating the mold part so as to allow the molten metal injected through the molten metal injection ports to flow into the molded product accommodating parts; and a molten metal injection control unit having upper and lower pressurizing parts for pressurizing the molten metal injected through the molten metal injection ports so as to allow the molten metal to flow into the molded product accommodating parts, together with the rotating unit.

The molten metal injection control unit may be configured to move up and down in the molten metal injection ports so as to connect or disconnect the molten metal injection ports and the molded product accommodating parts.

The molten metal injection control unit may be configured to move up and down in the molten metal injection ports so as to open or close a riser between the molten metal injection ports and the molded product accommodating parts.

The mold part may further include a sleeve attached to the molten metal injection ports and through which molten metal is able to be injected, wherein the sleeve is provided with an electromagnetic field transmission part through which an electromagnetic field is transmitted.

The sleeve may be formed from an electromagnetic field-shielding material having a hollow cylindrical shape whose upper and lower parts are opened, wherein the electromagnetic field transmission part is provided with a plurality of holes perforated at regular intervals along the sleeve, and a plurality of filler parts formed from an electromagnetic field transmitting material and that fill the plurality of holes.

The sleeve may be made from any one of SKD61 and STD61, and the filler parts may be formed from silicone.

An electromagnet module may be disposed around the sleeve.

Specifically, the upper and lower molds may respectively be provided with first and second molten metal injection ports passing along a central rotary axis, wherein the upper mold is provided, on a lower surface thereof, with one or more first casting grooves and first molten metal distribution passages respectively connecting the first casting grooves and the first molten metal injection port, wherein the lower mold is provided, on an upper surface thereof, with one or more second casting grooves and second molten metal distribution passages respectively connecting the second casting grooves and the second molten metal injection port, such that the first and second casting grooves and the first and second molten metal distribution passages are respectively formed to correspond to each other, and wherein, when the upper and lower molds are engaged, the first and second casting grooves facing each other form the molded product accommodating parts, and the first and second molten metal distribution passages facing each other form the risers.

First and second inner cores may respectively be attached to the first and second casting grooves.

The upper and lower pressurizing parts are disposed such that the upper and lower pressurizing parts are able to move in and out of the first and second molten metal injection ports along the central rotary axis of the upper and lower molds without interfering with the rotation of the rotary unit.

The upper pressurizing part may be attached to a first cylinder rod of a first pressurizing cylinder disposed upwards from the upper mold, and the lower pressurizing part may be attached to a second cylinder rod of a second pressurizing cylinder disposed downwards from the lower mold, and wherein the first pressurizing cylinder is fixedly attached to a sub-frame extending upwards from the upper mold without contacting the molten metal injection ports, and the second pressurizing cylinder is fixedly attached to the inside of the rotary body of the rotary unit.

According to a first embodiment, a molded product manufacturing method using the multiple pressure casting mold includes: moving up a lower pressurizing part in a mold part such that molten metal is not introduced towards the risers connecting molten metal injection ports and the molded product accommodating parts; injecting the molten metal towards an upper portion of the lower pressurizing part; introducing and solidifying the molten metal into molded product accommodating parts by moving down the upper pressurizing part such that the molten metal is introduced towards the risers, along with rotating the mold part; and, after the introduction and solidification of the molten metal, completing the manufacture of the molded product by disengaging the upper mold from the lower mold.

Specifically, the method may further include engaging the upper and lower molds together before the moving-up stage of the lower pressurizing part.

Specifically, the method may further include closing the molten metal injection port by moving down the upper pressurizing part in the molten metal injection port, between the injection stage and the introduction/solidification stage of the molten metal.

In the closing stage of the molten metal injection port, a lower surface of the upper pressurizing part may coincide with a surface of the molten metal.

In the molten metal introduction/solidification stage, an upper surface of the lower pressurizing part may be moved down and fixed to a position corresponding to the bottom of the riser by the upper pressurizing part that is moving down while pressurizing the molten metal, and then the molten metal is solidified while being introduced into the molded product accommodating parts along the riser by the upper pressurizing part that are continuously moving down.

In the molten metal introduction/solidification stage, when the upper surface of the lower pressurizing part coincides with the bottom of the riser, or otherwise when the lower surface of the moving-down upper pressurizing part coincides with an upper surface of the riser, the lower and upper pressurizing parts pressurize the molten metal at the same pressure.

According to a second embodiment, a molded product manufacturing method using the multiple pressure casting mold includes: moving down a lower pressurizing part to a position below risers connecting molten metal injection ports and molded product manufacturing parts; injecting molten metal between an upper surface of the lower pressurizing part and a lower section of the risers; moving down an upper pressurizing part in a mold part such that molten metal is not introduced towards the risers; introducing and solidifying the molten metal into molded product accommodating parts by moving up the lower pressurizing part such that the molten metal is introduced towards the risers, while rotating the mold part; and, after the introduction and solidification of the molten metal, completing the manufacture of the molded product by disengaging the upper mold from the lower mold.

Specifically, the method may further include engaging the upper and lower molds together before the moving-down stage of the lower pressurizing part.

In the moving-down stage of the upper pressurizing part, a lower surface of the upper pressurizing part may coincide with a surface of the molten metal.

In the molten metal introduction/solidification stage, the lower surface of the upper pressurizing part may be moved up and fixed to a position corresponding to an upper portion of the riser by the lower pressurizing part that is moving up while pressurizing the molten metal, and then the molten metal is solidified while being introduced into the molded product accommodating parts along the riser by the lower pressurizing part that are continuously moving up.

In the molten metal introduction/solidification stage, when the lower surface of the upper pressurizing part coincides with the upper portion of the riser, or otherwise when the upper surface of the lower pressurizing part coincides with the bottom of the riser, the lower and upper pressurizing parts pressurize the molten metal at the same pressure.

Further, the method may further include engaging the upper and lower molds together, between the molten metal injection stage and the moving-down stage of the upper pressurizing part.

Advantageous Effects

As described above, according to the present invention, there is an effect that, since upon casting, molten metal is injected towards the molded product accommodating part with the action of centrifugal force and pressure, as compared to a molded product manufactured by gravity casting, the molten metal can be quickly and uniformly injected, a molded product has excellent structure and strength, intrusion of air bubbles, slag, or the like can be reduced, and furthermore, use of a pouring gate, an overflowing, a riser, or the like can be minimized.

Further, according to the present invention, since the electromagnet module is provided around the molten metal injection ports and the sleeve is attached to the molten metal injection ports to allow a strong magnetic field of the electromagnet module to be collected in the molten metal injection ports, a structure of the molten metal can be advantageously and efficiently controlled in a state of the molten metal being semi-solidified.

Furthermore, according to the present invention, since the upper and lower pistons are provided to regulate a runner connected to a space for the molded product, the molten metal injected into the molten metal injection ports can be advantageously and sufficiently exposed to an electromagnetic field.

BEST MODE

Figure 1:
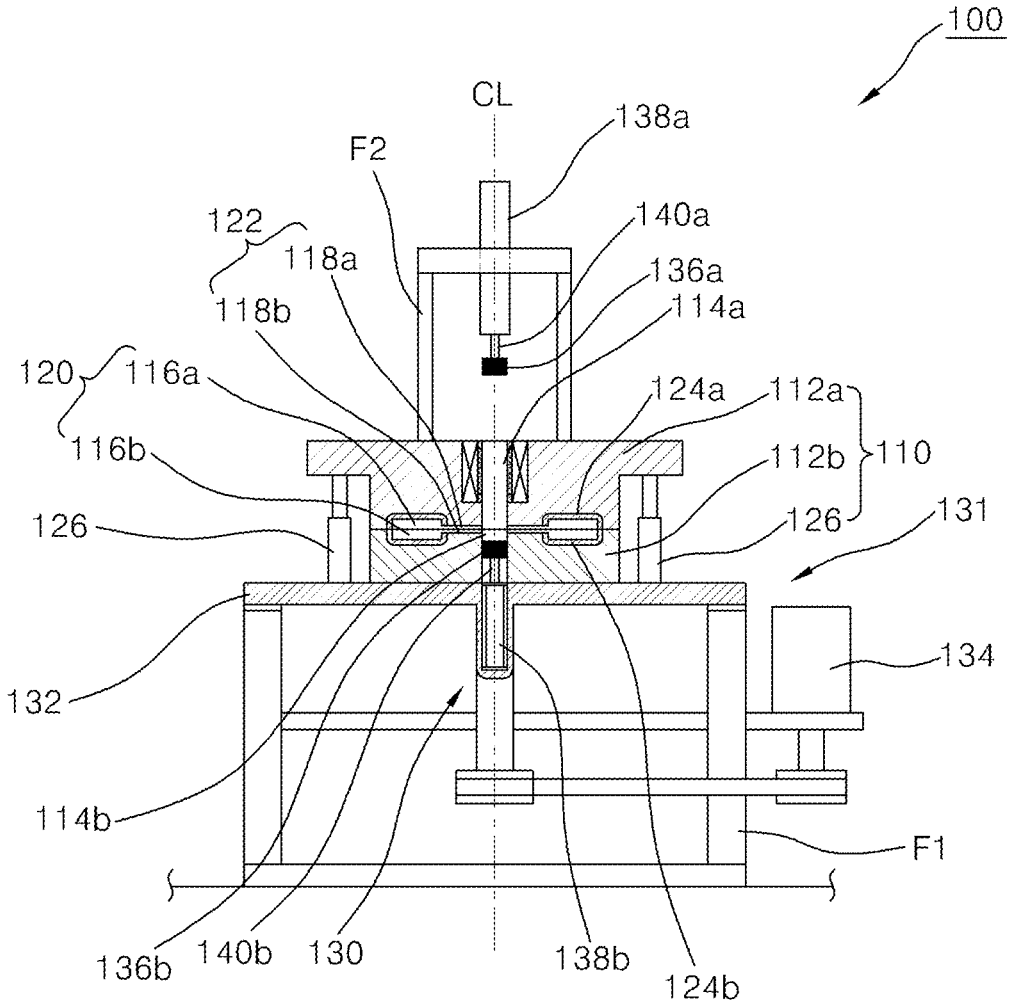
FIG. 1 is a cross-sectional view schematically illustrating a multiple pressure casting mold according to embodiments of the present invention.

Hereinafter, preferred embodiments of the present invention will be described in detail with reference to the accompanying drawings. Like parts are designated as like reference numerals throughout the drawings. Further, details of known functions and configurations that may make the gist of the present invention unnecessarily unclear will be omitted.

Figure 2:
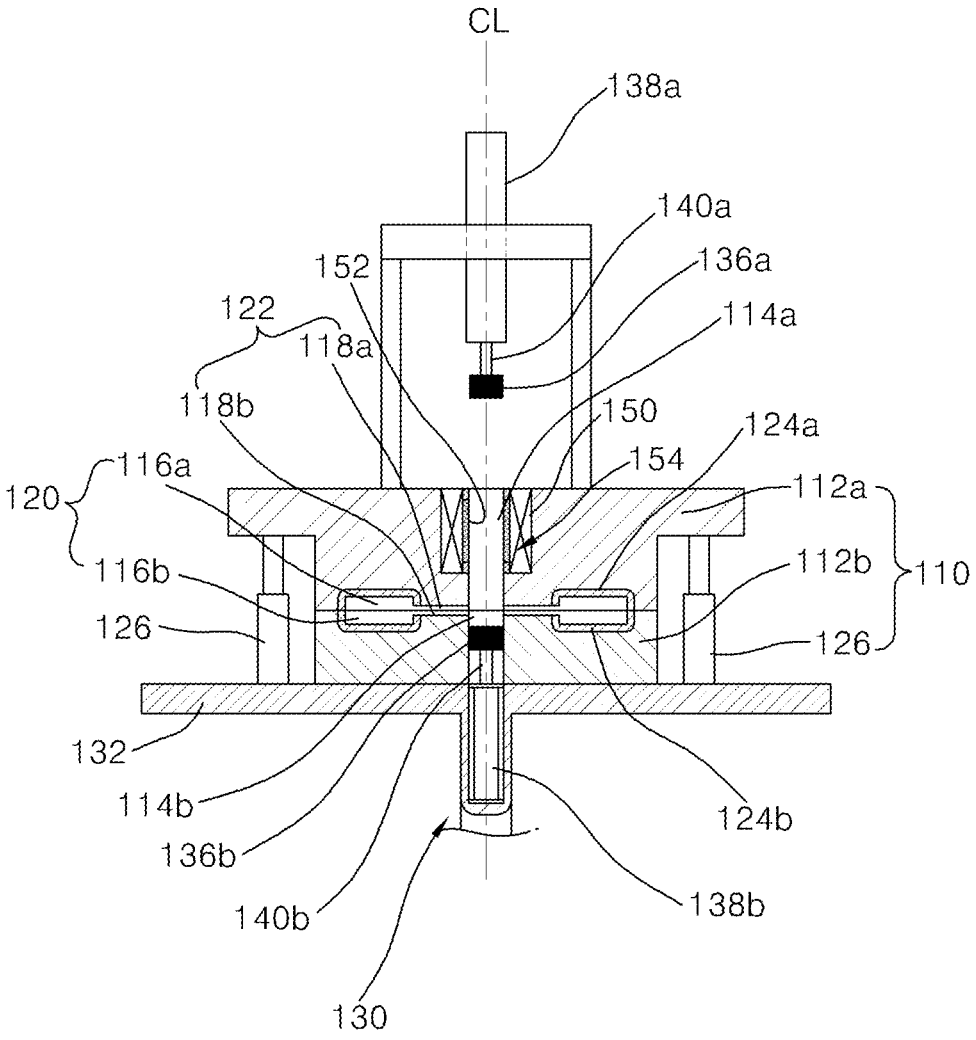
FIG. 2 is an enlarged cross-sectional view illustrating the multiple pressure casting mold of FIG. 1.

FIGS. 1 and 2 show a multiple pressure casting mold according to embodiments of the present invention, which includes a mold part 110 having one or more cavities 120 therein, and a molten metal injection control unit 130 that provides molten metal injected into the mold part 110 with centrifugal force and pressure during casting and allows the molten metal to flow into the cavities 120.

The mold part 110 includes upper and lower molds 112*a* and 112*b* disposed in a vertical direction.

When engaged (assembled), the upper and lower molds 112*a* and 112*b* define one or more molded product accommodating parts (also referred to as cavities) 120 in which a molded product is casted. To this end, the upper and lower molds 112*a* and 112*b* are respectively provided with first and second molten metal injection ports 114*a* and 114*b* passing along a central rotary axis CL. In addition, the upper mold 112*a* is provided, on a lower surface thereof, with one or more first casting grooves 116*a* and first molten metal distribution passages 118*a* respectively connecting the first casting grooves 116*a* and the first molten metal injection port 114*a*. Similarly, the lower mold 112*b* is provided, on an upper surface thereof, with one or more second casting grooves 116*b* and second molten metal distribution passages 118*b* respectively connecting the second casting grooves 116*b* and the second molten metal injection port 114*b*, such that the first and second casting grooves 116*a* and 116*b* and the first and second molten metal distribution passages 118*a* and 118*b* are respectively formed to correspond to each other.

When the upper and lower molds 112*a* and 112*b* are engaged, the first and second casting grooves 116*a* and 116*b* facing each other form the cavities 120, and the first and second molten metal distribution passages 118*a* and 118*b* facing each other form the risers 122.

That is, the molten metal is supplied into and fills the first and second molten metal injection ports 114*a* and 114*b* from an upper portion of the first molten metal injection port 114*a* when the upper and lower molds 112*a* and 112*b* are engaged, molten metal, or otherwise is injected into the second molten metal injection port 114*b* from an upper portion of the second molten metal injection port 114*b* and then fills the second molten metal injection port 114*b* when the upper mold 112*a* is engaged with the lower mold 112*b*. During casting, the filled molten metal is distributed and injected into the cavities 120 via the risers 122 connected to the cavities with the operation of a molten metal injection unit 130.

Here, respective risers 122 connected to the cavities 120 are passages diverging from inlets thereof connected to the first and second molten metal injection ports 114*a* and 114*b* towards outlets thereof connected to the cavities 120 in order for easy injection of the molten metal.

The first and second casting grooves 116*a* and 116*b* are respectively surface-coated with first and second inner cores 124*a* and 124*b* formed from ceramics or the like in order to protect the cavities 120 from high temperature molten metal when the upper and lower molds 112*a* and 112*b* are engaged.

The electromagnet module 150 is provided around the first molten metal injection port 114*a* formed in the upper mold 112*a* so as to generate an electromagnetic field from an external power source, and a sleeve 152 (see FIG. 3) is provided in the first molten metal injection port 114*a*, without interfering with the injection of the molten metal, so as to allow the electromagnetic field generated from the electromagnet module 150 to be collected in the first molten metal injection port 114*a*.

Figure 3:
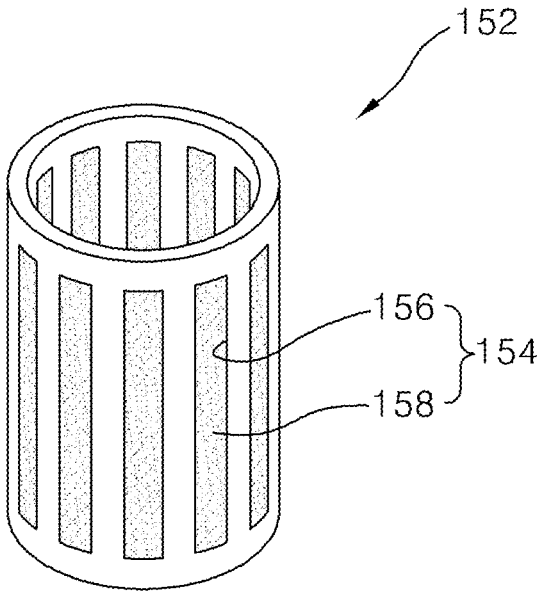
FIG. 3 is a perspective view illustrating a sleeve shown in FIG. 1.

As shown in FIG. 3, the sleeve 152 has a hollow cylindrical shape having upper and lower openings. The sleeve 152 is formed from hot-worked mold steel such as SKD61, STD61, or the like that is an electromagnetic field-shielding material. Here, the sleeve 152 has an electromagnetic field passage part 154 through which an electromagnetic field generated from the electromagnet module 150 is guided towards the first molten metal injection port 114*a*.

The electromagnetic field passage part 154 is provided with a plurality of holes 156 perforated at regular intervals along the sleeve 152, and a plurality of filler parts 158 formed from an electromagnetic field transmitting, heat-resistant material, such as silicone, and that fill the plurality of holes 156.

Like this, the sleeve 152 and electromagnet module 150 disposed around the first molten metal injection port 114*a* apply an electromagnetic field to the molten metal so as to change the molten metal to a semi-solidified metal while controlling the state of the molten metal (breakage of a dendritic microstructure, or grain refining by control of nucleation density and growth rate). Since the semi-solidified molten metal becomes solidified directly after being introduced into the cavities 120, a casting time can be shortened.

In addition, the application of the electromagnetic field to the injected molten metal reduces defects that may occur in a molded product and the grain refining may improve a variety of mechanical properties, thereby increasing the degree of freedom in designing a molded product (casting).

The mold part 110 further includes a mold coupler 126 that can connect or disconnect the upper and lower molds 112*a* and 112*b*.

The mold coupler 126 may have a variety of configurations. In an embodiment of the present invention shown in FIG. 1, the mold coupler 126 comprises an hydraulic cylinder device that is mounted to a rotary body 132 of a rotary section 131 in a molten metal injection control unit 130, which will be described later, so as to connect or disconnect the upper mold 112*a* to or from the lower mold 112*b* by moving up and down the upper mold 112*a*. However, it will apparent to those skilled in the art that the mold coupler 126 is not limited to the above-mentioned hydraulic cylinder device.

That is, any configuration may be employed if it is able to connect or disconnect the upper mold 112*a* to or from the lower mold 112*b* without interfering with the operation of the molten metal injection control unit 130.

The molten metal injection control unit 130 includes a rotary section 131 having a rotary body 132 to rotate the mold part 110 and allow the molten metal injected into the mold part 110 to be introduced into the cavities 120 during casting, and upper and lower pressurizing parts 136*a* and 136*b* pressurizing and introducing the molten metal in the mold part 110 towards the cavities 120 during casting. Here, the upper and lower pressurizing parts 136*a* and 136*b* may be a conventional plunger.

As shown, the rotary body 132 is disposed below the mold part 110. The rotary body 132 is rotatably supported by a frame F1 fixed to the ground or the like, and the lower mold 112*b* of the mold part 110 is detachably mounted to the rotary body 132 by a conventional clamping unit (not shown). Although the clamping unit is not illustrated in FIGS. 1 and 2, the clamping unit may have any configuration if it is able to detachably attach the lower mold 112*b* to the rotary body 132. Thus, the present invention does not limit the clamping unit to a specified configuration.

Further, the rotary body 132 is driven and rotated by a drive motor 134 supported by the frame F1 via a conventional power transmission, such as a belt and pulley, a sprocket and chain, a gear, or the like.

The upper and lower pressurizing parts 136*a* and 136*b* are disposed such that they can move in and out of the first and second molten metal injection ports 114*a* and 114*b* along a central rotary axis (CL) of the upper and lower molds 112*a* and 112*b* without interfering with the rotation of the rotary body 132. To this end, the upper pressurizing part 136*a* is attached to a first cylinder rod 140*a* of a first pressurizing cylinder 138*a* disposed upwards from the upper mold 112*a*, and the lower pressurizing part 136*b* is attached to a second cylinder rod 140*b* of a second pressurizing cylinder 138*b* disposed downwards from the lower mold 112*b*.

Here, the first pressurizing cylinder 138*a* is fixedly attached to a sub-frame F2 extending upwards from the upper mold 112*a* such that the first pressurizing cylinder can rotate together with the mold part 110 while pressurizing the molten metal, without contacting the first molten metal injection port 114*a*, and the second pressurizing cylinder 138*b* is fixedly attached to the inside of the rotary body 132 such that the second pressurizing cylinder can rotate together with the mold part 110.

The upper and lower pressurizing parts 136*a* and 136*b* attached to the first and second pressurizing cylinders 138*a* and 138*b* serve to pressurize and introduce the molten metal in the first and second molten metal injection ports 114*a* and 114*b* into the cavities 120 with the operation of the first and second pressurizing cylinders 138*a* and 138*b* during casting.

That is, the molten metal injected into the mold part 110 is introduced into the cavities 120 by a combination of operations of the rotary body 132 and the upper and lower pressurizing parts 136*a* and 136*b* during casting.

Hereinafter, a molded product manufacturing method using the multiple pressure casting mold 100 having the above-mentioned configuration will be described.

Figure 4:
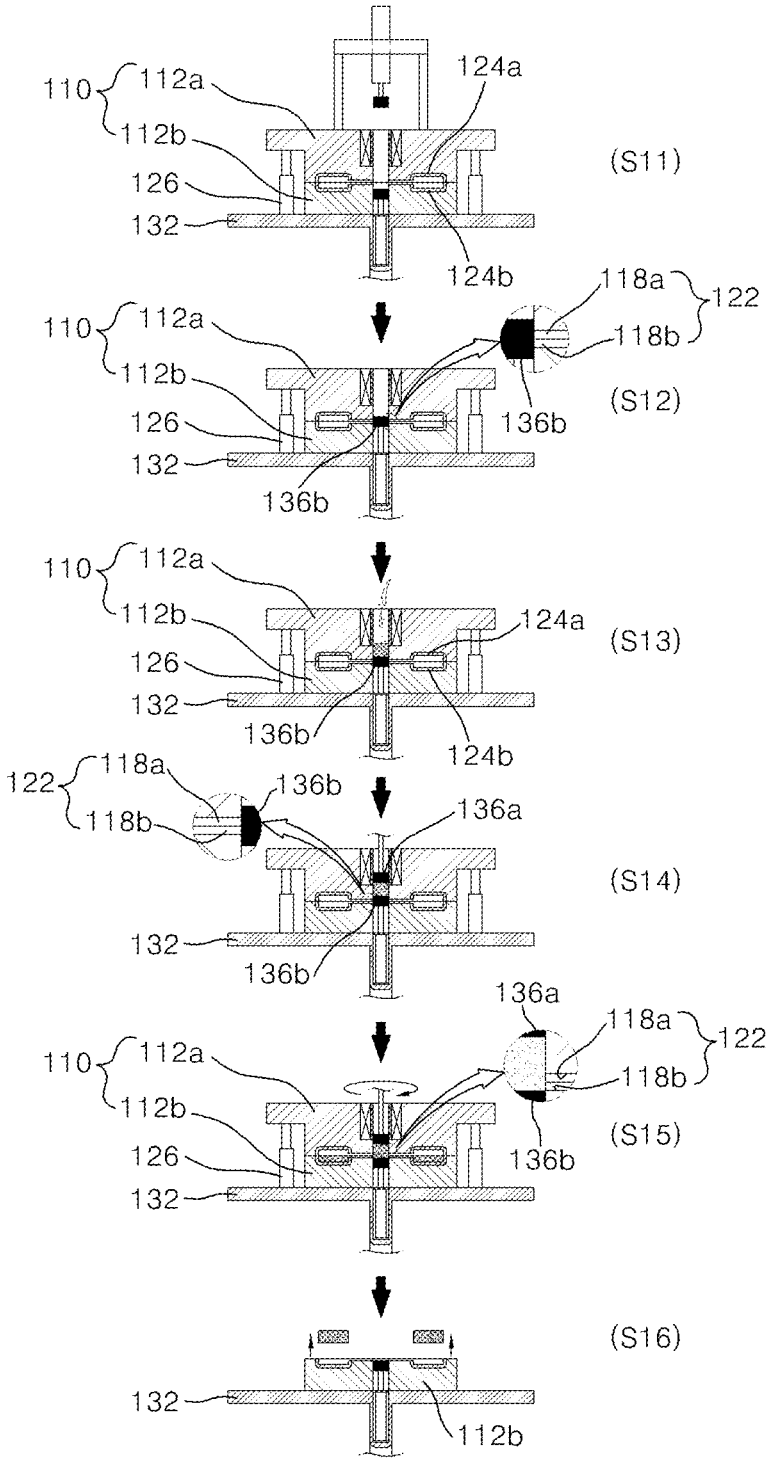
FIG. 4 is a process diagram illustrating a first embodiment of a molded product manufacturing method using the multiple pressure casting mold of FIG. 1.

FIG. 4 is a process diagram illustrating a first embodiment of the molded product manufacturing method using the multiple pressure casting mold of FIG. 1. The manufacturing method using the mold 100 includes engaging (assembling) the upper and lower molds 112*a* and 112*b* (S11).

The engagement of the upper and lower molds 112*a* and 112*b* is performed by attaching the lower mold 112*b* to the rotary body 132 and then moving down the upper mold 112*a* towards the lower mold 112*b*. That is, the upper mold 112*a* is engaged with the lower mold 112*b* by activating the mold coupler 126 attached to the upper mold 112*a* in a moving-down direction.

Here, the engagement of the upper and lower molds 112*a* and 112*b* is performed in a state in which the first and second inner cores 124*a* and 124*b* are attached to the first and second casting grooves 116*a* and 116*b*.

When the upper and lower molds 112*a* and 112*b* are engaged (S11), the lower pressurizing part 136*b* is moved upwards so as to prevent molten metal from flowing into the risers 122 connected to the first and second molten metal injection ports 114*a* and 114*b* (S12). Then, after a liquefied molten metal is injected towards the upper portion of the lower pressurizing part 136*b* (S13), the upper pressurizing part 136*a* is moved down into the first molten metal injection port 114*a* such that a lower surface of the upper pressurizing part 136*a* contacts a surface of the molten metal (S14).

Here, the molten metal in Stage S13 is injected into and fills the first molten metal injection port 114*a*, and then is changed into a semi-solidified molten metal by being electromagnetically stirred by the electromagnet module 150 while being cooled.

As described above, when the lower surface of the upper pressurizing part 136*a* coincides with the surface of the molten metal (S14), the upper pressurizing part 136*a* is moved down such that the molten metal is introduced towards the riser 122 closed by the lower pressurizing part 136*b*, and the upper and lower molds 112*a* and 112*b*, which are engaged, are rotated at high speed, such that the molten metal filling the inside of the first molten metal injection port 114*a* is solidified while being introduced into the cavities 120 (S15).

In S15, an upper surface of the lower pressurizing part 136*b* is moved down up to and fixed to a position corresponding to the bottom of the riser 122 by the upper pressurizing part 136*a* that is moving down while pressurizing the molten metal, and then the molten metal is solidified while being introduced into the cavities 120 along the riser 122 by the upper pressurizing part 136*a* that is continuously moving down.

In the meantime, in S15, when the upper surface of the lower pressurizing part 136*b* coincides with the bottom of the riser 122 by the action of the upper pressurizing part 136*a* that is moving down while pressurizing the molten metal, or otherwise the lower surface of the moving-down upper pressurizing part 136*a* coincides with an upper surface of the riser 122, the lower and upper pressurizing parts 136*b* and 136*a* pressurize the molten metal at the same pressure.

That is, the molten metal filling the mold part 110 is solidified while being injected towards the cavities 120 by centrifugal force provided during rotation of the rotary body 132 and pressurizing force applied between the upper and lower pressurizing parts 136*a* and 136*b*.

When the molten metal is introduced into the cavities 120 and is solidified as described above (S15), the upper mold 112*a* is disengaged from the lower mold 112*b* and then a solidified molded product is removed from the lower mold 112*b*, thereby completing the manufacture of the molded product (S16).

According to the first embodiment of the molded product manufacturing method using the multiple pressure casting mold as described before, since the molten metal is introduced towards the cavities 120 with the combined action of centrifugal force generated during the operation of the rotary section 131 and pressurizing force of the upper pressurizing part 136*a* pressurizing the molten metal during casting, the molten metal can be introduced towards the cavities 120 in a continuous, uniform manner and a molten metal-filling rate can be increased as well, thereby manufacturing a high quality molded product.

Figure 5:
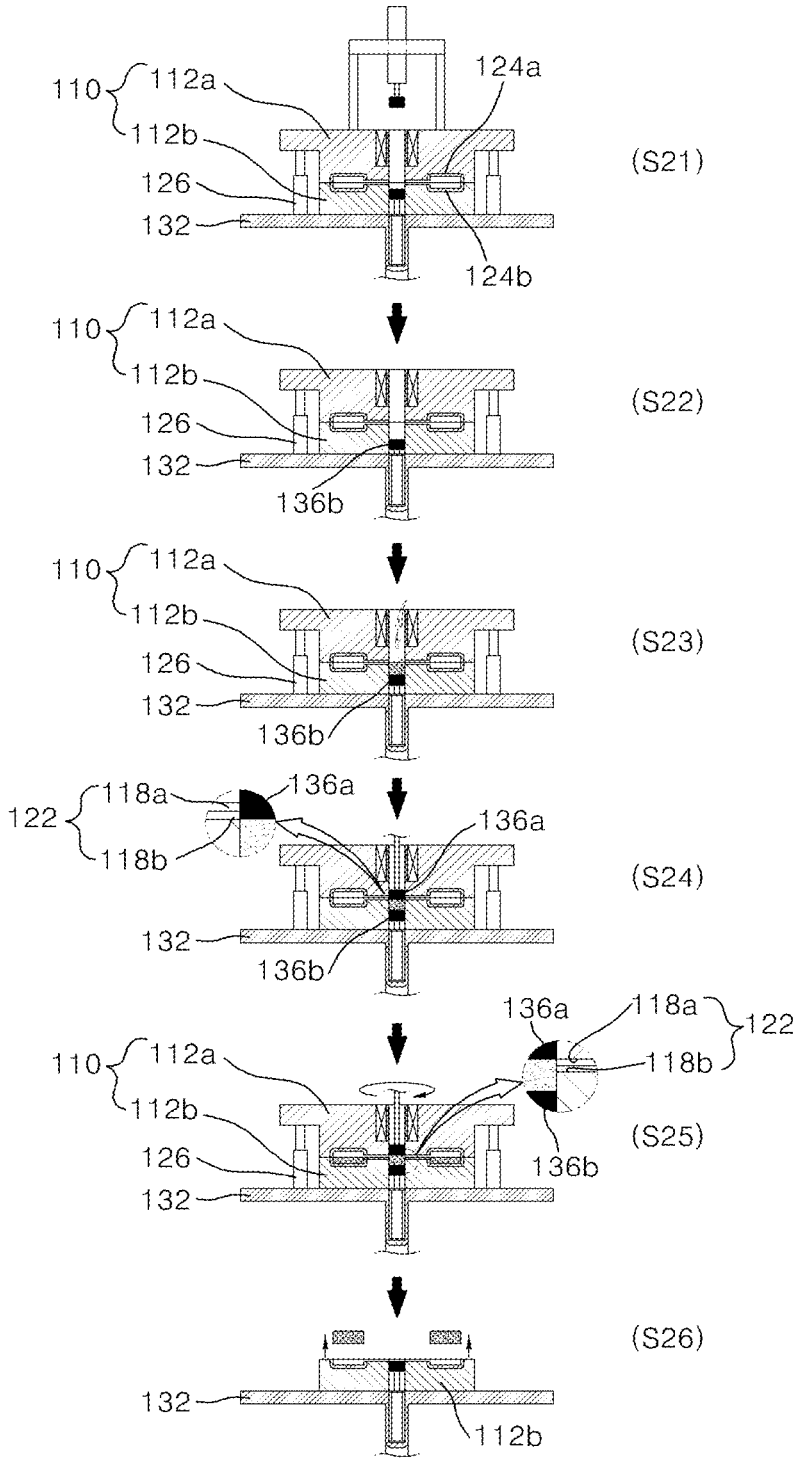
FIG. 5 is a process diagram illustrating a second embodiment of a molded product manufacturing method using the multiple pressure casting mold of FIG. 1.

FIG. 5 is a process diagram illustrating a second embodiment of the molded product manufacturing method using the multiple pressure casting mold of FIG. 1. The manufacturing method using the mold 100 includes engaging (assembling) the upper and lower molds 112*a* and 112*b* (S21).

The engagement of the upper and lower molds 112*a* and 112*b* is the same as that in S11 of the first embodiment, so a detailed description thereof will be omitted.

When the upper and lower molds 112*a* and 112*b* are engaged (S21), the lower pressurizing part 136*b* is moved down such that the upper surface thereof is disposed below the riser 122 (S22), and then a liquefied molten metal is injected between the upper surface of the lower pressurizing part 136*b* and a lower section of the riser 122 (S23). Then, after the molten metal is completely injected (S23), the upper pressurizing part 136*a* is moved down into the first molten metal injection port 114*a* such that the lower surface thereof coincides with the surface of the molten metal while preventing the molten metal from being introduced into the riser 122 (S24).

As described above, when the lower surface of the upper pressurizing part 136*a* coincides with the surface of the molten metal (S24), the lower pressurizing part 136*b* is moved up such that the molten metal is introduced towards the riser 122 closed by the upper pressurizing part 136*a*, and the upper and lower molds 112*a* and 112*b*, which are engaged, are rotated at high speed, such that the molten metal filling the inside of the second molten metal injection port 114*b* is solidified while being introduced into the cavities 120 (S25).

In S25, the lower surface of the upper pressurizing part 136*a* is moved up and fixed to a position corresponding to the upper surface of the riser 122 by the lower pressurizing part 136*b* that is moving up while pressurizing the molten metal, and then the molten metal is solidified while being introduced into the cavities 120 along the riser 122 by the lower pressurizing part 136*b* that is continuously moving up.

In the meantime, in S25, when the lower surface of the upper pressurizing part 136*a* coincides with the upper surface of the riser 122 by the action of the lower pressurizing part 136*b* that is moving up while pressurizing the molten metal, or otherwise the upper surface of the moving-up lower pressurizing part 136*b* coincides with the bottom of the riser 122, the lower and upper pressurizing parts 136*b* and 136*a* pressurize the molten metal at the same pressure.

When the molten metal is introduced into the cavities 120 and is solidified as described above (S25), the upper mold 112*a* is disengaged from the lower mold 112*b* and then a solidified molded product is removed from the lower mold 112*b*, thereby completing the manufacture of the molded product (S26).

According to the second embodiment of the molded product manufacturing method using the multiple pressure casting mold as described before, since the molten metal is introduced towards the cavities 120 with the combined action of centrifugal force generated during the operation of the rotary section 131 and pressurizing force of the lower pressurizing part 136*b* of the molten metal injection control unit 130 pressurizing the molten metal during casting, the molten metal can be introduced towards the cavities 120 in a continuous, uniform manner and a molten metal-filling rate can be increased as well, thereby manufacturing a high quality molded product.

Figure 6:
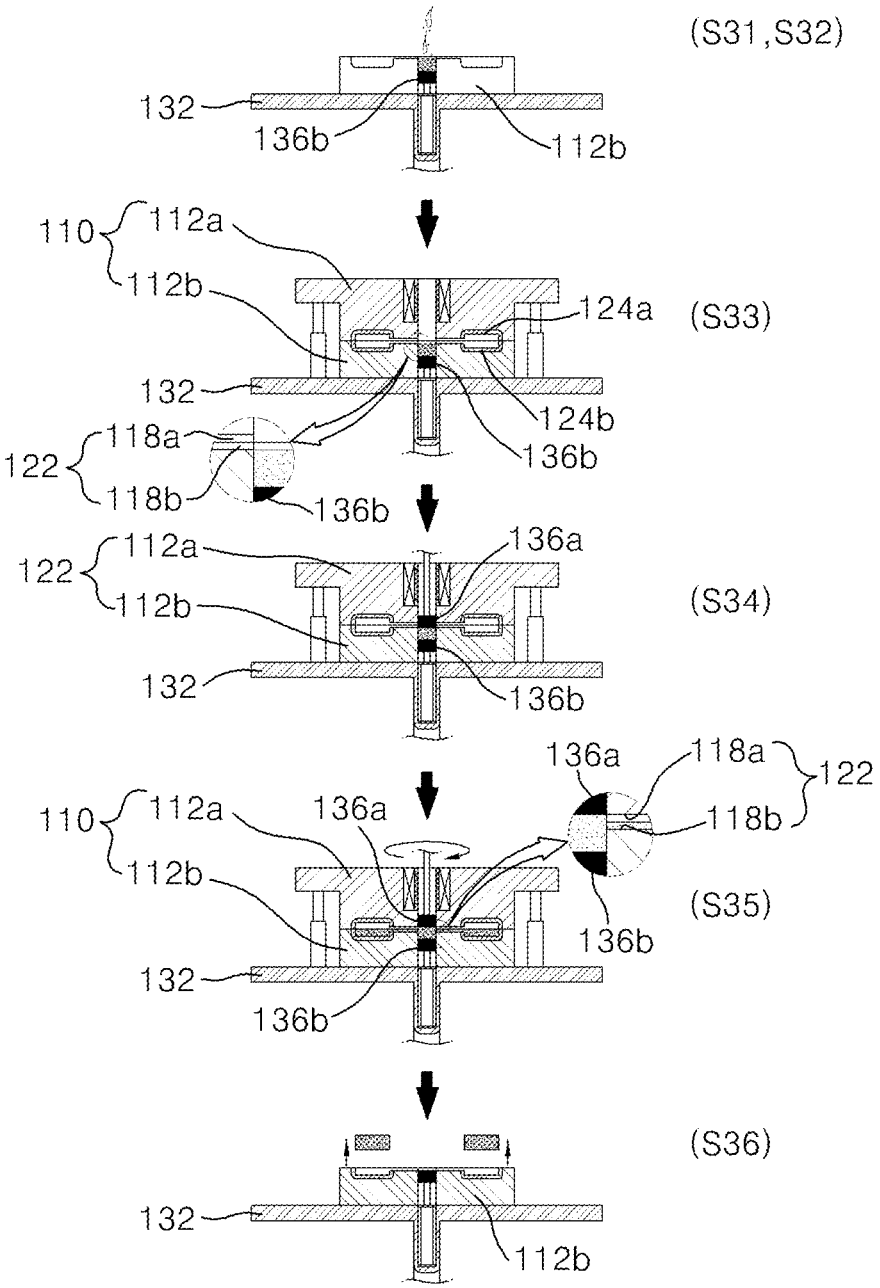
FIG. 6 is a process diagram illustrating a third embodiment of a molded product manufacturing method using the multiple pressure casting mold of FIG. 1.

FIG. 6 is a process diagram illustrating a third embodiment of the molded product manufacturing method using the multiple pressure casting mold of FIG. 1. The manufacturing method using the mold 100 includes the lower pressurizing part 136*b* that is moved down such that the upper surface thereof is disposed below the riser 122 (S31), and then a liquefied molten metal is injected between the upper surface of the lower pressurizing part 136*b* and a lower section of the riser 122 (S32).

After the molten metal is completely injected as described above (S32), the upper mold 112*a* is engaged with the lower mold 112*b* (S33), and then the upper pressurizing part 136*a* is moved down into the first molten metal injection port 114*a* such that the lower surface thereof coincides with the surface of the molten metal while preventing the molten metal from being introduced into the riser 122 (S34).

S33 is the same as S11 of the first embodiment, so a detailed description thereof will be omitted.

As described above, when the lower surface of the upper pressurizing part 136*a* coincides with the surface of the molten metal (S34), the lower pressurizing part 136*b* is moved up such that the molten metal is introduced towards the riser 122 closed by the upper pressurizing part 136*a*, and the upper and lower molds 112*a* and 112*b*, which are engaged, are rotated at high speed, such that the molten metal filling the inside of the second molten metal injection port 114*b* is solidified while being introduced into the cavities 120 (S35).

In S35, the lower surface of the upper pressurizing part 136*a* is moved up and fixed to a position corresponding to the upper surface of the riser 122 by the lower pressurizing part 136*b* that is moving up while pressurizing the molten metal, and then the molten metal is solidified while being introduced into the cavities 120 along the riser 122 by the lower pressurizing part 136*b* that are continuously moving up.

In the meantime, in S35, when the lower surface of the upper pressurizing part 136*a* coincides with the upper surface of the riser 122 by the action of the lower pressurizing part 136*b* that is moving up while pressurizing the molten metal, or otherwise the upper surface of the moving-up lower pressurizing part 136*b* coincides with the bottom of the riser 122, the lower and upper pressurizing parts 136*b* and 136*a* pressurize the molten metal at the same pressure.

When the molten metal is introduced into the cavities 120 and is solidified as described above (S35), the upper mold 112*a* is disengaged from the lower mold 112*b* and then a solidified molded product is removed from the lower mold 112*b*, thereby completing the manufacture of the molded product (S36).

According to the second embodiment of the molded product manufacturing method using the multiple pressure casting mold as described before, since the molten metal is introduced towards the cavities 120 with the combined action of centrifugal force generated during the operation of the rotary section 131 and pressurizing force of the lower pressurizing part 136*b* of the molten metal injection control unit 130 pressurizing the molten metal during casting, the molten metal can be introduced towards the cavities 120 in a continuous, uniform manner and a molten metal-filling rate can be increased as well, thereby manufacturing a high quality molded product.

Figure 7:
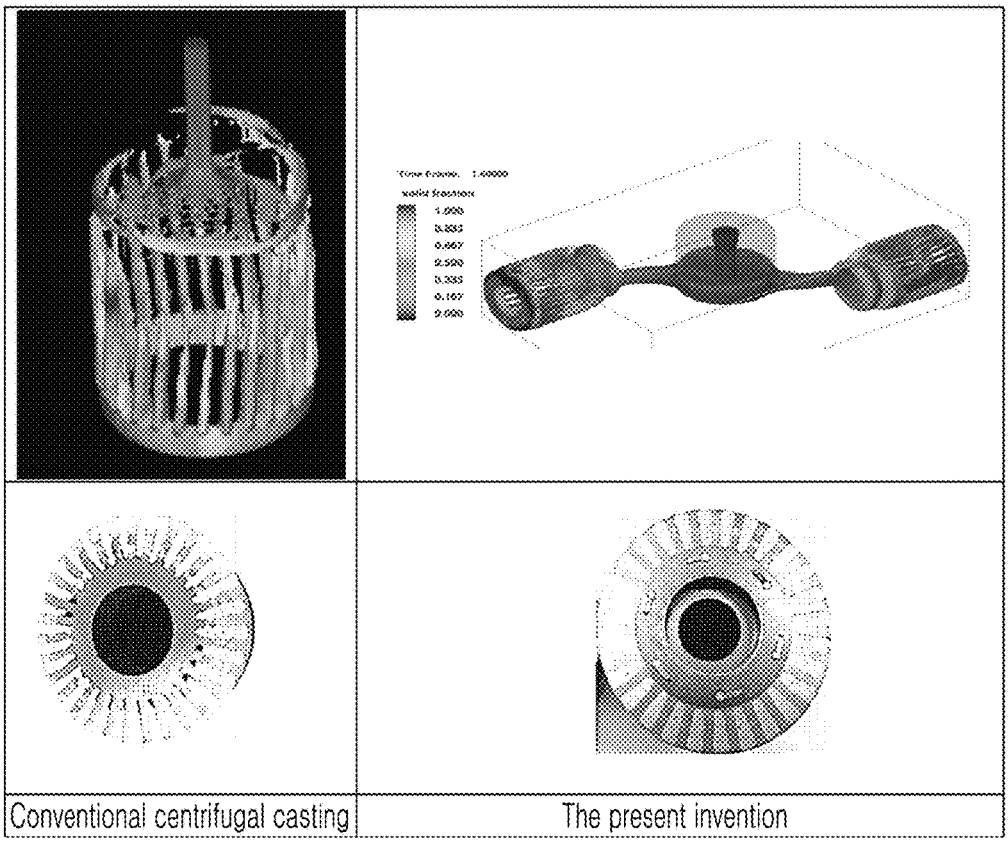
FIG. 7 illustrates the comparison of simulation results between molten metal flows according to the present multiple pressure casting and a conventional centrifugal casting, and the comparison between motor rotors actually manufactured by the both methods.

FIG. 7 shows simulation results of flowing of molten metal according to the multiple pressure casting method and a conventional centrifugal casting method. It could be seen that in the conventional centrifugal casting method, the molten metal does not uniformly fill the cavities since the filling is performed simply using a gravity force. On the contrary, according to the present casting method using the multiple pressure casting mold 100, it could be seen that, since the molten metal is pressurized by the molten metal injection control unit 130, the molten metal is injected into cavities 120 in a continuous, uniform manner. Further, it could be seen that the present casting method using the multiple pressure casting mold 100 shows a higher molten metal filling rate per a unit volume, compared to the conventional centrifugal casting method. As a result of an actual experiment, the present invention showed a molten metal filling rate that is increased by 5% to 10% or more, compared to the conventional centrifugal casting method.

The aforementioned multiple pressure casting mold and the molded product manufacturing method using the same are not limited to configurations and operating manners of the aforementioned embodiments. The embodiments may also be implemented into a variety of modifications through a selective combination of all or some of the embodiments.

DESCRIPTION OF THE REFERENCE NUMERALS IN THE DRAWINGS

100: Multiple pressure casting mold
110: Mold part
112*a*: Upper mold
112*b*: Lower mold
114*a*: $1^{st}$ molten metal injection port
114*b*: $2^{nd}$ molten metal injection port
116*a*: $1^{st}$ casting groove
116*b*: $2^{nd}$ casting groove
118*a*: 1st molten metal distribution passage
118*b*: $2^{nd}$ molten metal distribution passage
120: Molded product accommodating part (or Cavity)
122: Riser
124*a*: $1^{st}$ inner core
124*b*: $2^{nd}$ inner core
130: Molten metal injection control unit
132: Rotary body
134: Drive motor
136*a*: Upper pressurizing part
136*b*: Lower pressurizing part
138*a*: $1^{st}$ pressurizing cylinder
138*b*: $2^{nd}$ pressurizing cylinder
140*a*: $1^{st}$ cylinder rod
140*b*: $2^{nd}$ cylinder rod

What is claimed is:

1. A multiple pressure casting mold comprising:
a mold part including
upper and lower molds, each having molten metal injection ports and molded product accommodating parts for accommodating molten metal for a molded product;
a rotary unit including
a rotary body supporting the mold part on a bottom side of the mold part and configured to rotate the mold part so as to allow the molten metal injected through the molten metal injection ports to flow into the molded product accommodating parts; and
a molten metal injection control unit for pressurizing the molten metal injected through the molten metal injection ports so as to allow the molten metal to flow into the molded product accommodating parts, together with the rotary unit, the molten metal injection control unit including
a sub-frame disposed on and extending upward from the upper mold,
upper and lower pressurizing cylinders, and
upper and lower pressurizing parts,
wherein the upper pressurizing cylinder is fixedly attached to the sub-frame such that the upper pressurizing cylinder rotates along with the upper mold, and
the lower pressurizing cylinder is fixedly attached to the rotary body of the rotary unit such that the lower pressurizing cylinder rotates along with the rotary body, and
wherein the upper pressurizing part is attached to a cylinder rod of the upper pressurizing cylinder, and
the lower pressurizing part is attached to a cylinder rod of the lower second pressurizing cylinder.

2. The multiple pressure casting mold according to claim 1, wherein the upper and lower pressurizing parts of the molten metal injection control unit are configured to move up and down in the molten metal injection ports, respectively, so as to connect or disconnect the molten metal injection ports and the molded product accommodating parts.

3. The multiple pressure casting mold according to claim 1, wherein the upper and lower pressurizing parts of the molten metal injection control unit are configured to move up and down in the molten metal injection ports, respectively, so as to open or close a riser between the molten metal injection ports and the molded product accommodating parts.

4. The multiple pressure casting mold according to claim 1, wherein the mold part further includes a sleeve attached to the molten metal injection ports and through which the molten metal is able to be injected, wherein the sleeve is provided with an electromagnetic field transmission part through which an electromagnetic field is transmitted.

5. The multiple pressure casting mold according to claim 4, wherein the sleeve is formed from an electromagnetic field-shielding material having a hollow cylindrical shape whose upper and lower parts are opened, wherein the electromagnetic field transmission part is provided with a plurality of holes perforated at regular intervals along the sleeve, and a plurality of filler parts formed from an electromagnetic field transmitting material and filling the plurality of holes.

6. The multiple pressure casting mold according to claim 4, wherein the sleeve is made from any one of SKD61 and STD61, and the filler parts are formed from silicone.

7. The multiple pressure casting mold according to claim 4, wherein an electromagnet module is disposed around the sleeve.

8. The multiple pressure casting mold according to claim 1, wherein the molten metal injection ports include first and second molten metal injection ports passing along a central rotary axis of the upper and lower molds, respectively, wherein the upper mold is provided, on a bottom surface thereof, with one or more first casting grooves and one or more first molten metal distribution passages respectively connecting the first casting grooves and the first molten metal injection port, wherein the lower mold is provided, on a top surface thereof, with one or more second casting grooves and one or more second molten metal distribution passages respectively connecting the second casting grooves and the second molten metal injection port, such that the first and second casting grooves and the first and second molten metal distribution passages are respectively formed to correspond to each other, and wherein, when the upper and lower molds are engaged, the first and second casting grooves facing each other form the molded product accommodating parts, and the first and second molten metal distribution passages facing each other form risers.

9. The multiple pressure casting mold according to claim 8, wherein first and second inner cores are respectively attached to the first and second casting grooves.

10. The multiple pressure casting mold according to claim 1, wherein the upper and lower pressurizing parts are disposed such that the upper and lower pressurizing parts are able to move in and out of the first and second molten metal injection ports along a central rotary axis of the upper and lower molds without interfering with rotation of the rotary unit.

11. A molded product manufacturing method using the multiple pressure casting mold according to claim 1, the method comprising:
engaging the upper and lower molds such that first and second casting grooves face each other to form the molded product accommodating parts and first and second molten metal distribution passages face each other to form risers, wherein the risers connect the molten metal injection ports and the molded product accommodating parts;

moving up the lower pressurizing part in the molten metal injection ports such that the lower pressurizing part closes off the risers from the molten metal injection ports;

injecting the molten metal into the molten metal injection ports;

moving down the upper pressurizing part in the molten metal injection ports while rotating the mold part such that with the lower pressurizing part being moved down, the molten metal is introduced into the molded product accommodating parts through the risers; and after the molten metal is solidified in the molded product accommodating parts, disengaging the upper mold from the lower mold.

12. The molded product manufacturing method according to claim 11, wherein when moving down the upper pressurizing part in the molten metal injection ports, a bottom surface of the upper pressurizing part coincides with a surface of the molten metal.

13. The molded product manufacturing method according to claim 11, wherein when moving down the upper pressurizing part in the molten metal injection, the lower pressurizing part is moved down until a top surface of the lower pressurizing part coincides with a position corresponding to a bottom edge of the risers.

14. The molded product manufacturing method according to claim 13, wherein when the top surface of the lower pressurizing part coincides with the bottom edge of the risers, the lower and upper pressurizing parts pressurize the molten metal at the same pressure.

15. A molded product manufacturing method using the multiple pressure casting mold according to claim 1, the method comprising:

engaging the upper and lower molds such that first and second casting grooves face each other to form the molded product accommodating parts and first and second molten metal distribution passages face each other to form risers, wherein the risers connect the molten metal injection ports and the molded product accommodating parts;

moving down the lower pressurizing part in the molten metal injection ports such that a top surface of the lower pressurizing part is positioned below a bottom edge of the risers;

injecting the molten metal into the molten metal injection ports such that the molten metal is disposed between the top surface of the lower pressurizing part and the bottom edge of the risers;

moving down the upper pressurizing part in the molten metal injection ports such that the upper pressurizing part closes off the risers from the molten metal injection ports;

moving up the lower pressurizing part in the molten metal injection ports while rotating the mold part such that with the upper pressurizing part being moved up, the molten metal is introduced into the molded product accommodating parts through the risers; and after the molten metal is solidified in the molded product accommodating parts, disengaging the upper mold from the lower mold.

16. The molded product manufacturing method according to claim 15, wherein when moving up the lower pressurizing part in the molten metal injection, the upper pressurizing part is moved up until a bottom surface of the upper pressurizing part coincides with a position corresponding to a top edge of the risers.

17. The molded product manufacturing method according to claim 16, wherein when the bottom surface of the upper pressurizing part coincides with the top edge of the risers, the lower and upper pressurizing parts pressurize the molten metal at the same pressure.

* * * * *